US009611989B1

(12) United States Patent
Isaacson et al.

(10) Patent No.: US 9,611,989 B1
(45) Date of Patent: Apr. 4, 2017

(54) SYSTEMS AND METHODS FOR MODULAR INDIRECT LIGHTING

(75) Inventors: Chris Isaacson, Carlsbad, CA (US); Lisa Isaacson, Carlsbad, CA (US)

(73) Assignee: NuLEDs, Inc., Carlsbad, CA (US)

( * ) Notice: Subject to any disclaimer, the term of this patent is extended or adjusted under 35 U.S.C. 154(b) by 494 days.

(21) Appl. No.: 12/268,379

(22) Filed: Nov. 10, 2008

Related U.S. Application Data

(60) Provisional application No. 60/986,588, filed on Nov. 8, 2007, provisional application No. 60/989,801, filed on Nov. 21, 2007.

(51) Int. Cl.
*F21S 4/00* (2016.01)

(52) U.S. Cl.
CPC ..... *F21S 4/00* (2013.01)

(58) Field of Classification Search
CPC ..... F21S 4/20
USPC ..... 353/30, 94; 359/443, 460; 362/601, 605, 362/612, 97.1, 97.4, 147, 231
See application file for complete search history.

(56) References Cited

U.S. PATENT DOCUMENTS 5,251,065 A * 10/1993 Uetsuki ..... 359/454
6,000,812 A * 12/1999 Freeman et al. ..... 362/249.01
6,026,602 A * 2/2000 Grondal et al. ..... 40/570
7,220,019 B2 * 5/2007 Cheung et al. ..... 362/235
7,530,712 B2 * 5/2009 Lin et al. ..... 362/247
7,637,620 B2 * 12/2009 Montierth et al. ..... 353/98
2003/0043567 A1 * 3/2003 Hoelen et al. ..... 362/31
2005/0219860 A1 * 10/2005 Schexnaider ..... 362/601
2006/0028622 A1 * 2/2006 Nojima et al. ..... 353/75
2007/0127230 A1 * 6/2007 Chung et al. ..... 362/97
2007/0147034 A1 * 6/2007 Li ..... 362/231
2007/0211491 A1 * 9/2007 Chou ..... 362/601

* cited by examiner

*Primary Examiner* — Bryon T Gyllstrom
(74) *Attorney, Agent, or Firm* — Robroy R. Fawcett

(57) ABSTRACT

A lighting system can comprise a frame, a material attached on a front facing surface of the frame and a plurality of LEDs mounted within the frame. Light emitted from the LEDs is directed to the material from behind the front facing surface of the frame. In some of these embodiments, the material passes a portion of the emitted light thereby causing the transmitted emitted light to appear as if light reflects or emanates from a front surface of the material. A controller is described that controls color of the emitted light to form patterns on the front surface of the material. The plurality of LEDs can include different colored LEDs, multi-color LEDs and RGB LEDs. The RGB LEDs can be controlled to respond to a video signal, thereby displaying a video image on the material. The material comprises a textured material and may possess a three-dimensional profile.

20 Claims, 5 Drawing Sheets
(2 of 5 Drawing Sheet(s) Filed in Color)

SYSTEMS AND METHODS FOR MODULAR INDIRECT LIGHTING

CROSS-REFERENCE TO RELATED APPLICATIONS

The present Application claims priority from U.S. Provisional Patent Application No. 60/986,588 filed Nov. 8, 2007, entitled "Systems and Methods for Modular Indirect Lighting," and from U.S. Provisional Patent Application No. 60/989,801 filed Nov. 21, 2007, entitled "Systems and Methods for Modular Indirect Lighting," which applications are incorporated by reference herein in their entirety.

BACKGROUND OF THE INVENTION

Field of the Invention

The present invention relates generally to lighting systems.

BRIEF SUMMARY OF THE INVENTION

Certain embodiments of the invention provide systems and methods for creating lighting effects. In one example, an easy-to-install ceiling domes includes an individually hand painted sky mural lit by an indirect cove light which dims like a sunset to reveal a night sky full of twinkling fiber optic stars. In some embodiments. lighting control is provided to enhance lighting experience. Lighting and lighting control can be customized according to need or desire.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

DETAILED DESCRIPTION OF THE INVENTION

Figure 1:
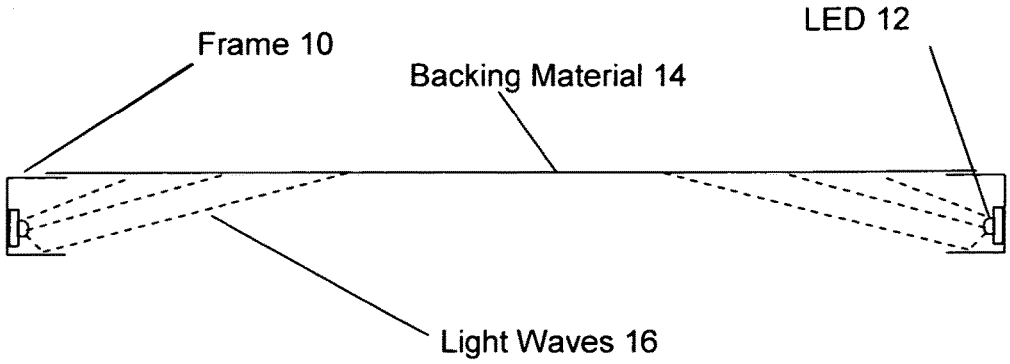
FIG. 1 illustrates a display system according to aspects of the invention.

Embodiments of the present invention will now be described in detail with reference to the drawings, which are provided as illustrative examples so as to enable those skilled in the art to practice the invention. Notably, the figures and examples below are not meant to limit the scope of the present invention to a single embodiment, but other embodiments are possible by way of interchange of some or all of the described or illustrated elements.

Certain embodiments of the invention provide systems and methods for creating lighting effects. In one example, an easy-to-install ceiling dome includes an individually hand-painted sky mural lit by an indirect cove light which dims like a sunset to reveal a night sky full of twinkling fiber optic stars. In some embodiments, a lighting control system is provided to enhance lighting experience. The lighting control system may be implemented on a commercially available computing platform and/or may comprise customized components such as embedded computers, sequencers, timers and LED drivers. In the night sky example, the pattern of stars that would be viewable may reflect the night sky at the time and place of birth of a person, of an event in history or at any other time and place. The lighting control system may be programmed to emulate the night sky as viewable from a selected or preferred location and time. The control system may simulate sunrise, sunset, moonrise and/or moonset and may vary the intensity of simulated stars and/or star fields. The intensity of one or more stars may be varied to create a twinkling effect.

In certain embodiments, the lighting system can be constructed in the form of one or more tiles, such as acoustic tiles or panels. The tiles can be provided in standard building sizes such as ranges of tiles having a size from 2'×2' up to 4'×8'. Tiles can be installed into a traditional drop ceiling grid, surface mounted to drywall, or as part of a structure such as crown molding or a cove. Edges are typically hardened and wrapped. Custom cutouts can be made for can lights, sprinklers, etc. In certain embodiments, displays can be constructed from one or more plain rigid fiberglass tiles wrapped with Guilford of main fabric or any desired finish. Thus, it will be appreciated, displays can be created in a variety of shapes and sizes.

Lighting control of individual portions or panels of the lighting system may be distributed among plural lighting controllers. Distributed control may comprise LED, electroluminescent, LCD and other drivers. Distributed control may be used to vary backlighting for the controlled portion or panel. Distributed control may also comprise sequence control, whereby the sequence of lighting intensity for the portion or panel is determined by a prerecorded sequence of instructions, an analog or digital stream of control information or by commands received from a central controller. Communications methods usable between distributed controller and main controller include connections through panels, copper or fiber communication links provided separately to each panel, wireless communications, addressable column and line controls, etc.

In certain embodiments, other forms of lighting panels can be provided. For example, a concave window façade can be created as a modular LED lighting display. In one example, a display comprises thirty 7 ft×12 ft aluminum frames lined with RGB LED strips that wash a semitransparent fabric material with full color illumination. Each one-foot strip is a unique pixel forming a matrix, which allows a user to run animated graphic files. Each panel may be constructed as a 'plug and play' module that can be mounted temporarily in standalone or combinatorial fashion and can be removed for storage until the next holiday or event. Behind the scenes is a complex infrastructure of communication equipment controlled by a master computer. Animated graphics can be incorporated in the display.

In certain embodiments, a lighting system comprises a frame upon which a material can be added. The material is typically provided on a front facing surface of the frame, opposite a back-facing surface that can be attached to a wall or other mount. The material, when mounted on the front facing surface typically obscures or otherwise hides components used to drive illumination and mount the frame. The material may be plain or decorative and may be presented as a field of color and may include one or more images. The material may be textured, smooth or some combination of both textured and smooth; for example, one portion may be smooth while another portion is provided with ridges, dimples, roughness and so on. Furthermore, the frame may include members that stretch or otherwise form the material according to a desired profile.

Figure 6:
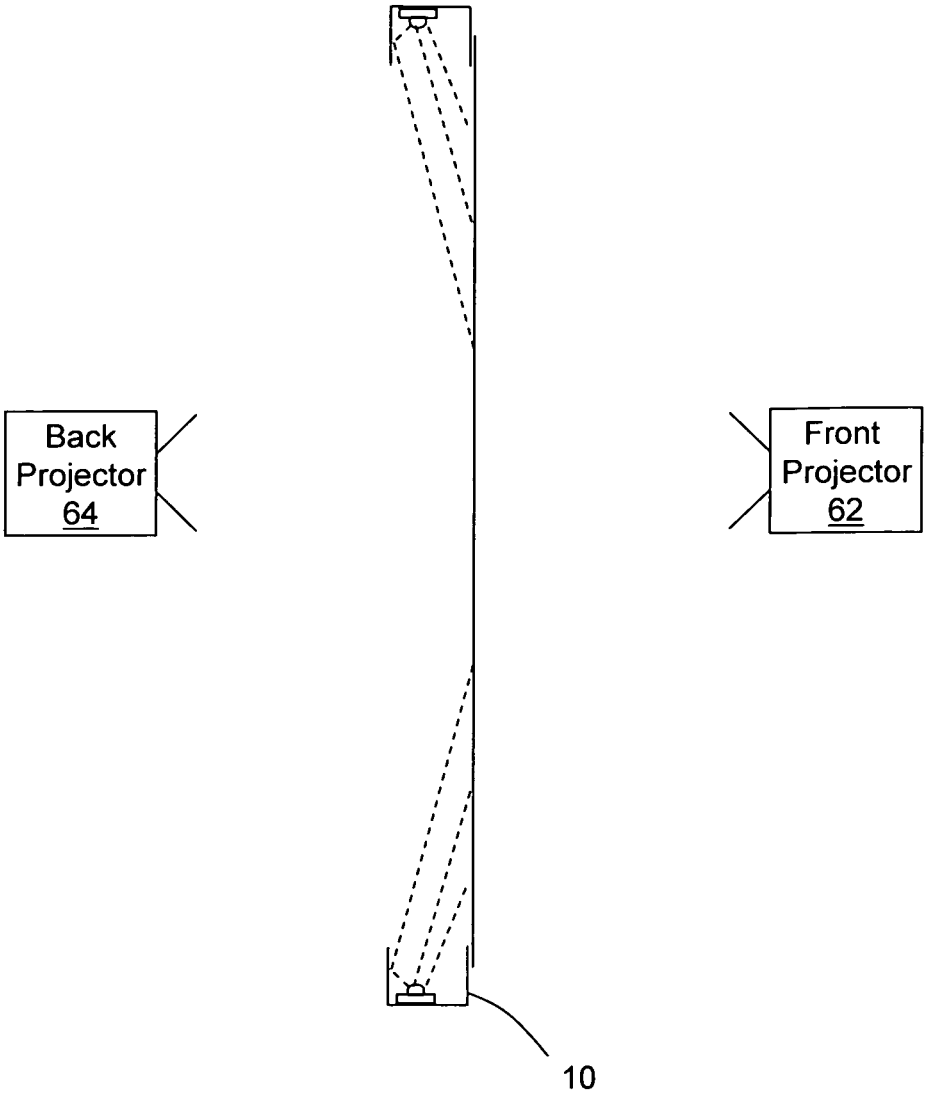
FIG. 6 illustrates a display system with projectors.

In one embodiment, the material comprises a webbed material that passes a portion of incident light and may also reflect a portion of incident light. Thus a combination of back lighting, front projection and back projection may be employed to obtain a desired lighting effect. In one example, a plurality of LEDs can be mounted within the frame 10 such that emitted light of the LEDs is directed to the back of a webbed or other material. Sufficient light passes through the material that the light appears to emanate or be reflected from the front surface of the material. By varying the color of the LED light, patterns can be formed on the front surface of the material. The LEDs may include individual colored LEDs and can also comprise multi-color LEDs. These LEDs can be electronically controlled to form the desired pattern on the front surface of the material. With reference to FIG. 6, in addition or in place of the LED light, a front projector 62 may be used to illuminate the front surface of the material. Although front projection techniques may be used, it is typically desirable to back-project images to the back surface of the material. Advantages of back projection include the concealment of a back projector 64 and the production of diffused images, based on the light conducting properties of the material used.

Certain embodiments of the invention provide a lighting system comprising a frame that can be manufactured according to specifications and requirements of a specific application. In that regard, the frame may be constructed to form an outline having a desired shape and size. In one simple example depicted in FIG. 1, the frame 10 can take the form of an open square or rectangular box; in other embodiments, the frame may be in the form of a circle or other shape. Light 16 may be generated by LEDs 12 or other light sources and directed to a backing material 14. The frame may permit the use of a light reflective and/or conductive material that has a three dimensional profile. For example, a circular frame can be constructed with a support structure that supports a reflective surface that is generally spherical, or dome shaped. The support structure may be a solid spherical material and may be a framework of supports that maintain the shape of a light conducting/reflecting surface. In at least some embodiments, the reflecting/conducting surface may be formed from a material that has sufficient stiffness and/or resilience to maintain its spherical shape without additional support. For example, the surface can be formed on a molding.

Figure 2:
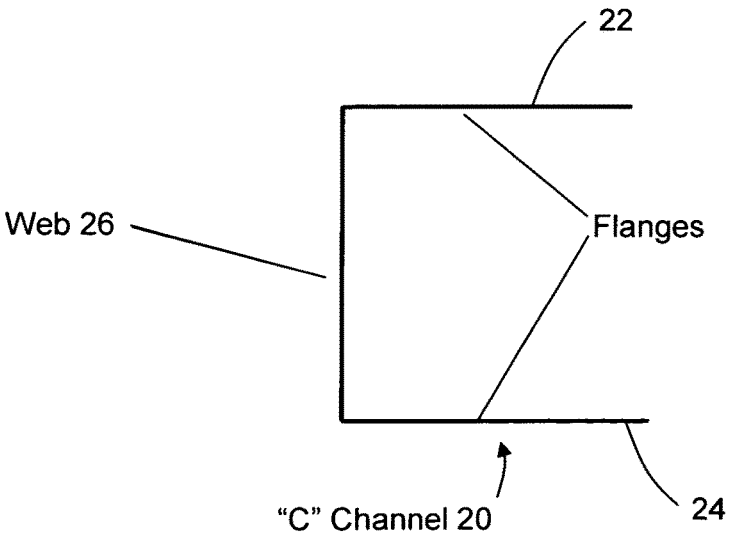
FIG. 2 illustrates a display system according to aspects of the invention.

In certain embodiments, frames 10 are constructed of members having a C-channel 20 comprising a front flange 22, a rear flange 24, and a web 26 as depicted in FIG. 2. The open side of the channel of the members can be oriented toward the inside perimeter of the frame such that the open channels open toward each other. Typically, a web is provided on the outside perimeter. Frame members can be provided having a desired shape or length and can be joined to other frame members to complete the desired frame shape. Thus, a frame can be constructed to have any desired size and shape.

In certain embodiments, the inside of the channel is colored white to facilitate reflection of the light. It is contemplated that the insides of the channels can be coated with a reflective or light absorbing material as desired.

The frame 10 typically includes means for attaching a material for transmitting and/or reflecting light. The material can possess a combination of different properties where the properties can include translucence, transparency, opaqueness, rigidity, solidity, flexibility and mesh. In certain embodiments, the material is white in color. Other colors may be selected as desired to obtain a desired degree of reflection and/or refraction of light provided by lights such as LEDs 12. In certain embodiments, the material is provided as a continuous extension of the channel.

The lighting system also typically comprises a plurality of lights. Typically these lights are LED lamps or arrays but can easily be provided by other light sources or reflectors. In certain embodiments some of lights provide light to the material which may then transmit, reflect and/or refract portions of the provided light to obtain a desired lighting effect.

In certain embodiments, LEDs 12 can be mounted on the inside surface of the channel web so that their light washes the material. LEDs 12 are selected to obtain a desired number of light sources, brightness, and beam width to illuminate the entire material. The LEDs 12 may be mounted such that they cannot be seen directly by an observer of the finished device.

LEDs 12 and other light types may be selected based on any number of characteristics including color, uniformity of color, RGB capability for color mixing, variability of intensity for color mixing and for brightness and an ability to control the LEDs individually or in groups mounted on a printed circuit board ("PCB").

Figure 3:
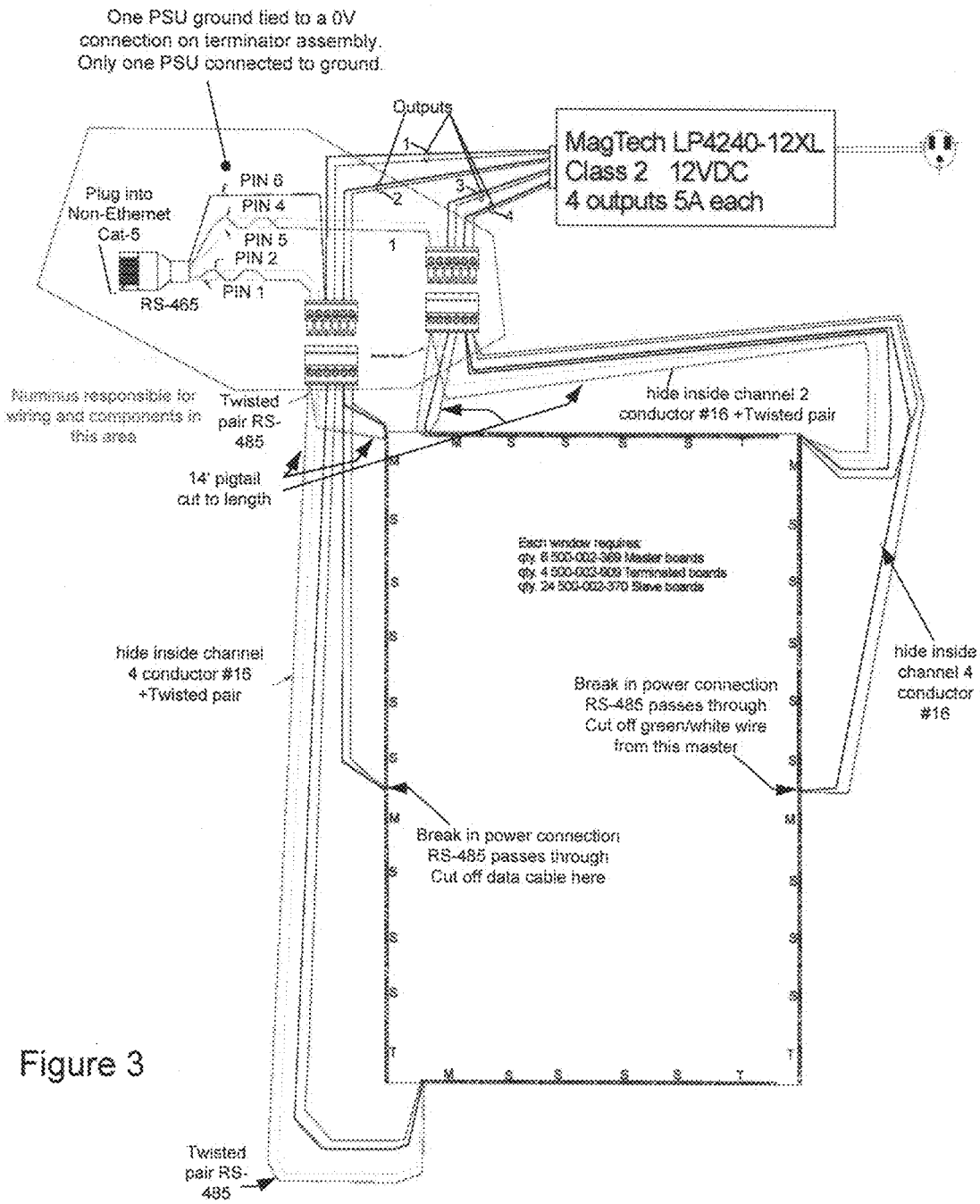
FIG. 3 illustrates a lighting control system according to aspects of the invention.
Figure 4:
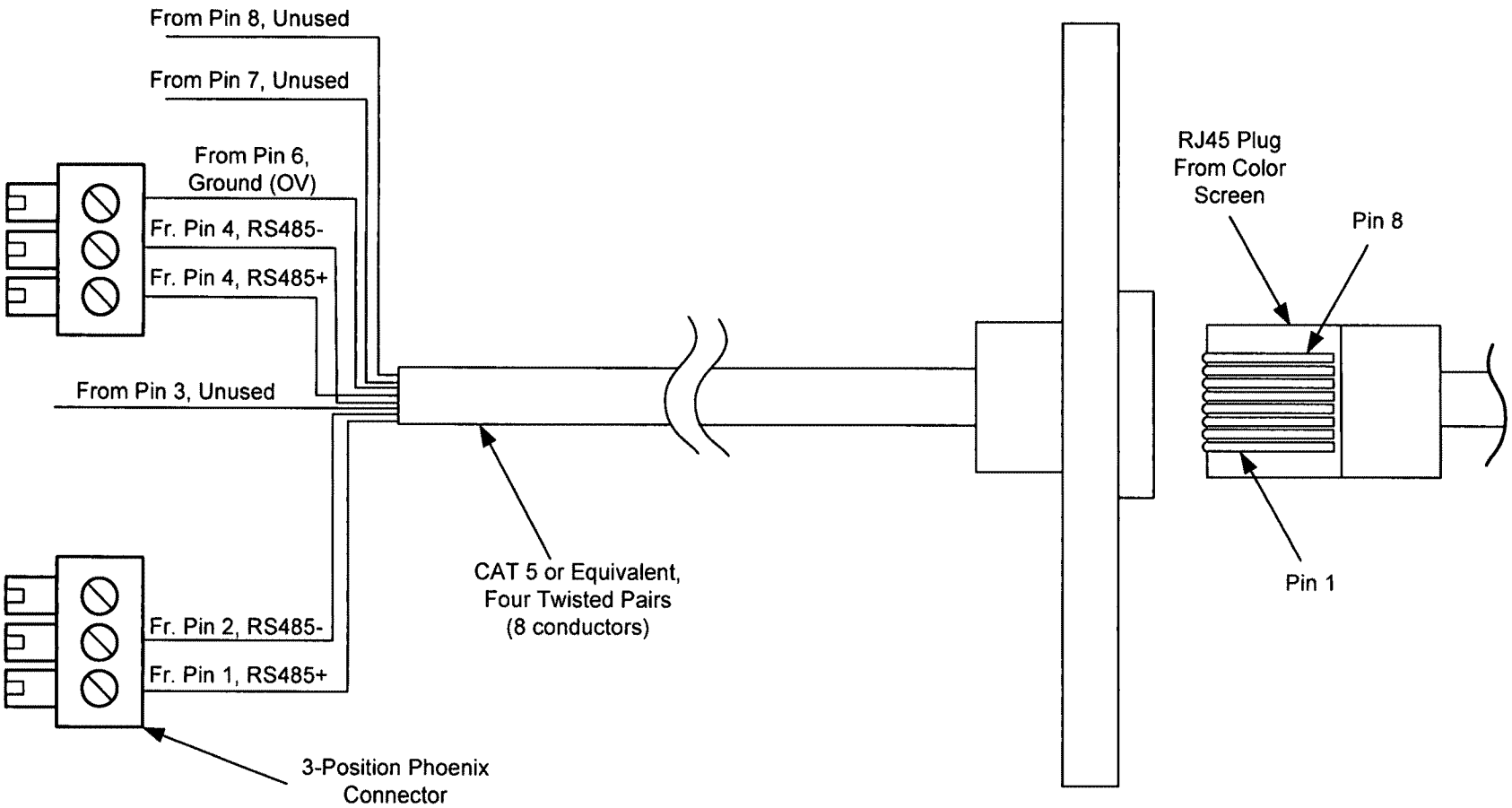
FIG. 4 illustrates a lighting control system according to aspects of the invention.
Figure 5:
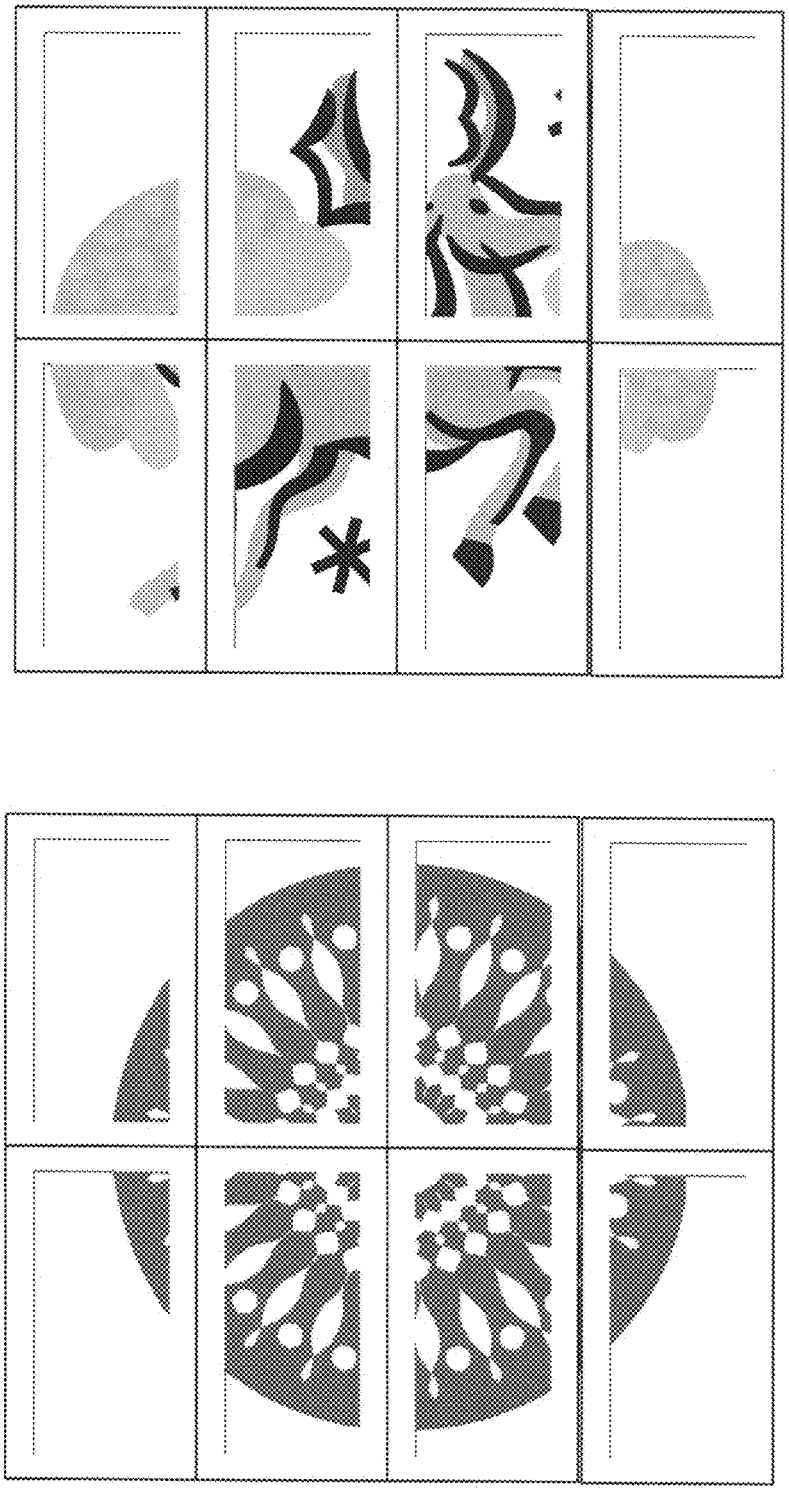
FIG. 5 illustrates display systems according to aspects of the invention.

Frames can be constructed to have a desired geometric shape, and plural frames can be arranged in an array of frames. With sufficient power and controls, and using RGB LEDs in small groups, an array of frames can be used to play "Soft Video™" that is a controlled blending of colors on the frame reflective/transmitting material as opposed to pixilated video. FIGS. 3 and 4 depict examples of control electronics that may be used to drive the LEDs to obtain the desired color patterns and sequences of patterns. With reference to FIG. 5, in many embodiments, patterns and/or images displayed on individual frames are coordinated with displays on other frames. Thus, an object can be made to appear to be arranged across or move across the face of two or more frames with smooth transitions between frames. Furthermore, video may be superimposed on the patterns or images displayed on the frames.

Additional Descriptions of Certain Aspects of the Invention

The foregoing descriptions of the invention are intended to be illustrative and not limiting. For example, those skilled in the art will appreciate that the invention can be practiced with various combinations of the functionalities and capabilities described above, and can include fewer or additional components than described above. Certain additional aspects and features of the invention are further set forth below, and can be obtained using the functionalities and components described in more detail above, as will be appreciated by those skilled in the art after being taught by the present disclosure.

Certain embodiments of the invention provide a lighting system. Some of these embodiments comprise a frame, a material attached on a front facing surface of the frame and a plurality of LEDs mounted within the frame. In some of these embodiments, emitted light from the LEDs is directed to the material from behind the front facing surface of the frame. In some of these embodiments, an opposite back-facing surface of the frame is configured for attachment to a mount. In some of these embodiments, the material passes a portion of the emitted light. In some of these embodiments, the portion of emitted light appears to be reflected from a front surface of the material. In some of these embodiments, the material passes a portion of the emitted, wherein the portion of emitted light appears to emanate from a front surface of the material.

Some of these embodiments further comprise a controller. In some of these embodiments, the controller controls color of the emitted light to form patterns on the front surface of the material. In some of these embodiments, the plurality of LEDs includes different colored LEDs. In some of these embodiments, the plurality of LEDs includes multi-color LEDs. In some of these embodiments, the controller controls the color emanating from the multi-color LEDs. In some of these embodiments, the plurality of LEDs includes groups of RGB LEDs and wherein the controller controls the groups of red-green-blue ("RGB") LEDs in response to a video signal, thereby displaying a video image on the material. In some of these embodiments, the video image is a blended image. In some of these embodiments, the video image is superimposed on one or more patterns generated by certain of the plurality of LEDs. In some of these embodiments, the material comprises a webbed material. In some of these embodiments, the material comprises a textured material. In some of these embodiments, the textured material has a three-dimensional profile.

Some of these embodiments further comprise a projector for projecting an image onto the material. In some of these embodiments, the frame includes members having a C-channel comprising a front flange, a rear flange, and a web. In some of these embodiments, the frame is substantially rectangular. In some of these embodiments, the frame is generally dome shaped. In some of these embodiments, the material is selected for one or more of a plurality of optical properties including translucence, transparency, opaqueness, rigidity, solidity, flexibility and mesh.

Although the present invention has been described with reference to specific exemplary embodiments, it will be evident to one of ordinary skill in the art that various modifications and changes may be made to these embodiments without departing from the broader spirit and scope of the invention. Accordingly, the specification and drawings are to be regarded in an illustrative rather than a restrictive sense.

What is claimed is:

1. A lighting system, comprising:

a frame including members each having a C-channel comprising a front flange, a rear flange, and a perpendicular web;

a material attached on the front flanges of the members of the frame; and a plurality of LEDs mounted to the perpendicular webs of the members of the frame, wherein emitted light from the LEDs is directed to the material from behind the front flanges of the members of the frame, wherein at least a portion of the emitted light directly illuminates the material, and wherein at least a portion of the emitted light is reflected by the rears flanges to illuminate the material.

2. The system of claim 1, wherein the material passes a portion of the emitted light, wherein the portion of emitted light appears to be reflected from a front surface of the material.

3. The system of claim 1, wherein the material passes a portion of the emitted light, wherein the portion of emitted light appears to emanate from a front surface of the material.

4. The system of claim 3, further comprising a controller, wherein the controller controls color of the emitted light to form patterns on the front surface of the material.

5. The system of claim 4, wherein the plurality of LEDs includes different colored LEDs.

6. The system of claim 4, wherein the plurality of LEDs includes multi-color LEDs.

7. The system of claim 6, wherein the controller controls the color emanating from the multi-color LEDs.

8. The system of claim 6, wherein the plurality of LEDs includes groups of RGB LEDs and wherein the controller controls the groups of RGB LEDs in response to a video signal, thereby displaying a video image on the material.

9. The system of claim 8, wherein the video image is a blended image.

10. The system of claim 8, wherein the video image is superimposed on one or more patterns generated by certain of the plurality of LEDs.

11. The system of claim 1, wherein the material comprises a webbed material.

12. The system of claim 1, wherein the material comprises a textured material.

13. The system of claim 1, further comprising a projector for projecting an image onto the material.

14. The system of claim 1, wherein the frame is substantially rectangular.

15. The system of claim 1, wherein the material is selected for one or more of a plurality of optical properties including translucence, transparency, opaqueness, rigidity, solidity, flexibility, and mesh.

16. The system of claim 1, wherein at least one rear flange is configured for attachment to a mount.

17. The system of claim 1, wherein each perpendicular web is perpendicular to the front flange of the respective member of the frame.

18. The system of claim 17, wherein each perpendicular web is entirely perpendicular to the entire front flange of the respective member of the frame.

19. The system of claim 1, wherein each perpendicular web is perpendicular to the rear flange of the respective member of the frame.

20. The system of claim 19, wherein each perpendicular web is entirely perpendicular to the entire rear flange of the respective member of the frame.

* * * * *